US005967650A

United States Patent [19]

Laughlin

[11] Patent Number: 5,967,650

[45] Date of Patent: Oct. 19, 1999

[54] PROTECTIVE SHIELD FOR ILLUMINATED HOLLOW FRANGIBLE COLLECTIBLES

[76] Inventor: William A. Laughlin, 1243 Avondale La., West Palm Beach, Fla. 33409

[21] Appl. No.: 09/053,642

[22] Filed: Apr. 2, 1998

[51] Int. Cl.[6] ..... F21V 21/00

[52] U.S. Cl. ..... 362/396; 362/124; 362/226; 362/267; 362/432; 362/438; 362/443; 362/457; 362/806; 362/808; 362/809

[58] Field of Search ..... 362/226, 396, 362/124, 267, 438, 432, 457, 443, 806, 808, 809

[56] References Cited

U.S. PATENT DOCUMENTS 3,531,634 9/1970 Plouch ..... 362/253
5,730,522 3/1998 Wyke et al. ..... 362/432

*Primary Examiner*—Sandra O'Shea
*Assistant Examiner*—John Anthony Ward
*Attorney, Agent, or Firm*—William J. Daniel

[57] ABSTRACT

A collectible structure of delicate frangible hollow construction having a circular or other shaped opening in its rear wall is provided with a relatively axially short protective sleeve of tough composition fitting within the opening and retained therein, e. g. by frictional engagement with the opening edges. An illuminating unit having a light source for illuminating the collectible structure from its interior is placed within the sleeve with the light source disposed within the structure interior beyond the inner end of the sleeve. Attached to the unit are resilient spring supporting means therefor, preferably in the form of plural resilient outwardly-directed fingers, in engagement with an interior surface of the sleeve so that the sleeve surface bears the force of the supporting means. Preferably, the sleeve has a short arcuate segment removed from its perimeter to permit the sleeve to be compressed to fit different sized openings.

5 Claims, 2 Drawing Sheets

PROTECTIVE SHIELD FOR ILLUMINATED HOLLOW FRANGIBLE COLLECTIBLES

FIELD OF THE INVENTION

This invention relates to the field of decorative collectibles and particularly decorative hollow collectibles, as contrasted from collectible plates, solid dolls and so on, which are constructed of ceramic, such as porcelain, or other delicate, and therefore frangible material, and are illuminated from within for enhanced decorative effect and is concerned more particularly with a protective shield for substantially reducing the risk of breakage of the collectible caused by the illuminating device associated therewith.

BACKGROUND OF THE INVENTION

There are many different kinds of ornamental or decorative articles that are currently manufactured and sold with the intent of collection by those to whom the particular article has some kind of sentimental, emotional, historical or nostalgic appeal. Such articles can be collected with a view to creating a charming even beautiful display within one's home. While some of these articles retain only an intrinsic ornamental value, others after the passage of time and especially where the specific article was issued in limited quantity and/or experiences an unexpected demand can undergo an increase in economic value which can become surprisingly large. Thus, there can be a strong financial incentive to protect such articles from breakage or damage in addition to the normal desire to preserve one's possessions and since it is difficult if not impossible to predict in advance which collectible is likely to increase in value over time, this incentive tends to apply generally.

A very popular type of collectible in recent years are miniature hollow structures fashioned to resemble, or even reproduce on a small scale, some structure often well known having an historical or nostalgic significance or otherwise having a sentimental appeal or, alternatively, as a fanciful creation from a designer's imagination. The variety of subjects qualifying for such treatment is virtually unlimited and include castles, churches, lighthouses, cottages, manor houses, taverns, early rowhouses, figures, scenic views, etc., both historical and imaginary. Most of these articles by their very nature include openings or perforations and sometimes areas of reduced thickness and to augment their ornamental or decorative attraction, are illuminated from within their interior so that light streams from the openings or creates a translucence in thin regions.

For such illumination, these miniature structures have a special opening, preferably circular, in a rear, and ordinarily unseen, wall and an illuminating unit, such as a low wattage light bulb and associated socket, is disposed in this opening with a light cord extending to a convenient electrical source. A reasonably secure mounting of the socket within the rear wall opening is obviously desirable. While this objective could surely be achieved in many ways, one popular solution is to attach to opposite sides of the socket, opposed stiffly resilient spring fingers (or "wings") of steel, plastic or the like extending angularly outwardly relative to the socket axis in generally V-shaped fashion away from the bulb end of the socket. The angle of inclination of the fingers relative to their length is sufficient that the transverse separation of the fingers at at least a short distance inwardly from their free ends exceeds the diameter, or some other dimension in case the opening is not circular. The spring fingers are preferably flat but could have other shapes, e. g. rod-like.

Thus, the free ends of the spring fingers are compressed together for insertion in the rear opening and when released are spring-biased by their resiliency outwardly against opposite side edges of that opening. With flat spring fingers and a circular opening as preferred, the planes of the fingers extend chordally of the opening on opposite sides thereof. To insure that the spring fingers are retained in their engaged position, and resist the socket-bulb assembly from becoming dislodged by the spring action of the fingers or otherwise, a positive engagement over and above friction alone between the fingers and opening edges is preferably provided. For example, on opposite sides of the respective spring fingers at a point along their length where their separation is greater than the rear opening dimension, there can be, and preferably are, small indentations, such as short shallow U-shaped notches or the like. When the illuminating assembly is inserted in the rear opening and the spring fingers released, these indentations receive or catch on edge portions of the rear structure wall opening and effectively prevent unintended axial displacement of the fingers from the opening edges until the fingers are again deliberately compressed.

This technique while effective for mounting the light-socket unit within the collectible, has an important drawback. As stated above, the hollow structures are of delicate construction with a wall thickness of only ⅛ in or so and the rear opening edges are quite susceptible to damage from their engagement by the notched spring fingers of the unit. The security of this engagement in anchoring the unit in place is primarily a function of spring finger resiliency; strong resiliency is thus desirable but increases the risk of damage and loss of value. The bulb-socket unit is typically occasionally removed and replaced from an item, as e. g. when a collection of the collectibles is re-arranged for a different visual effect or replaced with a different collection in a seasonal change. The "attack" of the spring fingers on the opening edges can therefore be progressive, chipping away the edges with an increasing possibility of causing a major crack in the structure and diminishing or even destroying its value.

OBJECTS OF THE INVENTION

The object of the invention is to provide a protective annular shield frictionally retained in a rear opening of an illuminated hollow collectible structure for engagement by V-extending spring fingers of an illuminating unit inserted into the rear opening for consequential protection of the opening edges against damage by such spring fingers.

A more specific object is an annular sleeve of a durable resiliently flexible material such as tough resilient plastic, which is configured for insertion and frictional retention in the rear opening of a hollow collectible prior to placement of an illuminating unit therein so that the sleeve is interposed between spread-apart spring fingers supporting the illuminating unit within the rear opening and the edge of such rear opening to protect the edge from destructive contact by the fingers.

A still further obkect is a durable resilient annular circular protective sleeve for the purpose in question which is slotted over a short arc of its periphery to enable the diameter of the sleeve to be varied within certain limits to fit in different opening sizes in the rear walls of different collectibles.

SUMMARY OF THE INVENTION

In accordance with the invention, a hollow collectible structure of delicate frangible construction having a circular or other shaped opening in its rear wall has a relatively axially short protective sleeve of tough composition projecting through the opening and retained therein, e. g. by frictional engagement with its edges. An illuminating unit for illuminating the collectible structure from its interior is placed within the sleeve with a light source disposed within the structure interior beyond the inner sleeve end resilient spring supporting means for the unit is in engagement with an interior surface of the sleeve so that the sleeve surface bears the force of the supporting means.

DETAILED DESCRIPTION OF ILLUSTRATIVE EMBODIMENTS OF THE INVENTION

Figure 3:
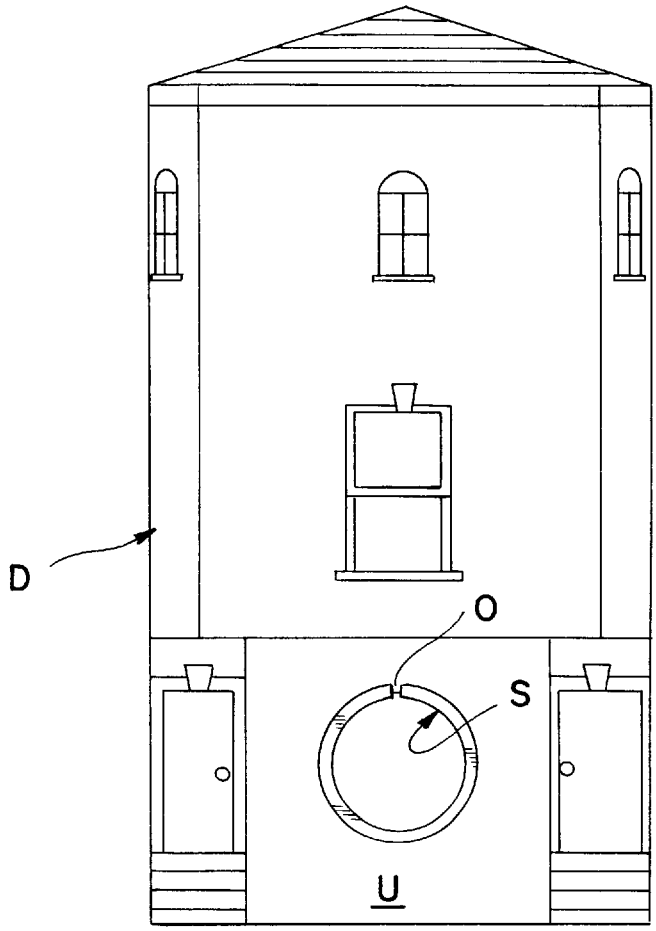
FIG. 3 is a rear elevation view of a representative miniature collectible structure, somewhat simplified for clarity, showing in the rear wall a rear opening for reception of the illuminating device, not shown, with the protective shield of the invention in operative position in such opening, the protective shield being in slightly circumferentially compressed condition from its relaxed state to conform to the dimensions of the rear opening.
Figure 4:
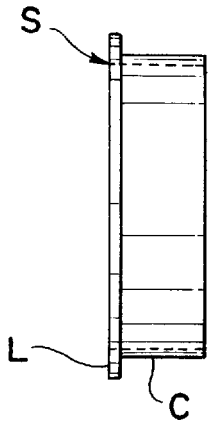
FIG. 4 is a right side elevation view of the embodiment of the invention seen in FIGS. 1–3 alone, i. e. independently of the collectible structure and illuminating device.

Referring initially to FIG. 3, there is shown a rear view of a representative hollow miniature collectible structure, designated D, which is illustrative of the kinds of such structures that are available in the market. These structures are typically constructed by molding or the like from ceramic material including but not restricted to porcelain, although other materials can certainly be substituted. This particular structure, to which the invention is obviously not limited, is a miniature three-story "tower" house or town house having on its rear wall U various decorative features, as can be seen, including large and small windows and "dual" doors, one of each side of its lowest or first story, with a short series of steps leading upward from ground level to each door. The front wall of the structure, not seen, will naturally include other ornamental aspects.

Disposed centrally of the first floor level of rear wall U is a circular opening O, only a small portion of which is visible in FIG. 3, for reception of an illuminating device, not shown in FIG. 3. which projects through the opening into the interior of the hollow structure behind the rear wall U. While a circular opening is preferred for this purpose, other shapes such a square or rectangular or otherwise could be utilized if desired. The opening O can most conveniently be formed by the molding operation but could conceivably be formed in the rear wall in some other manner. As shown in FIG. 3, one embodiment of the protective shield, generally designated S, of the invention is in operative position within the circular opening O of the structure.

Figure 1:
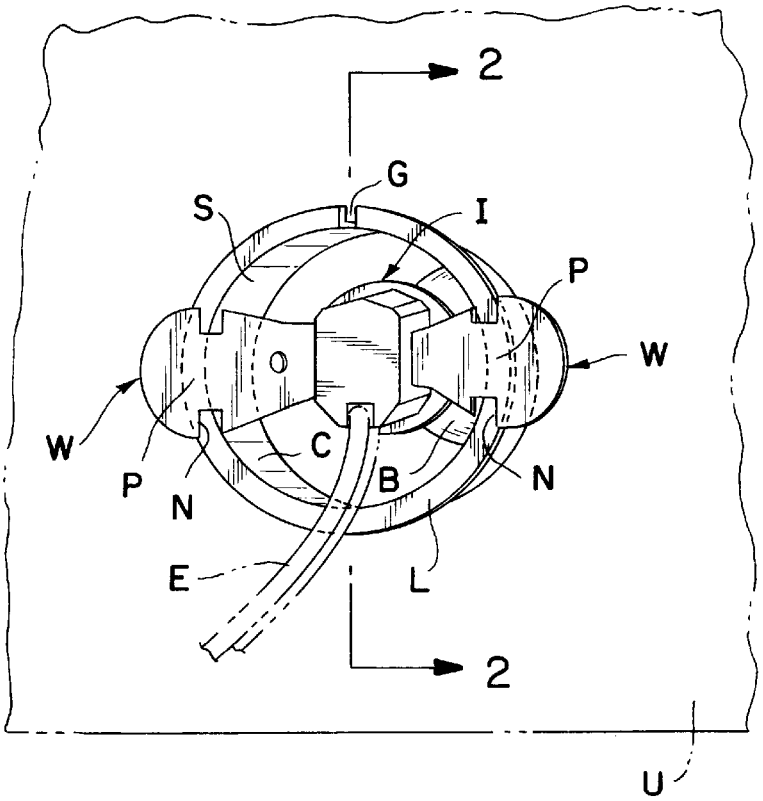
FIG. 1 is a fragmentary view somewhat enlarged in perspective of a portion of the rear wall, shown in broken lines, of a collectible structure having an opening therein in association with one embodiment of the protective shield of the invention in operative position within the opening and showing a conventional illuminating device constituted of an electric bulb held in an electrical socket and resilient spring fingers extending from the socket for supporting the same in illuminating position.
Figure 2:
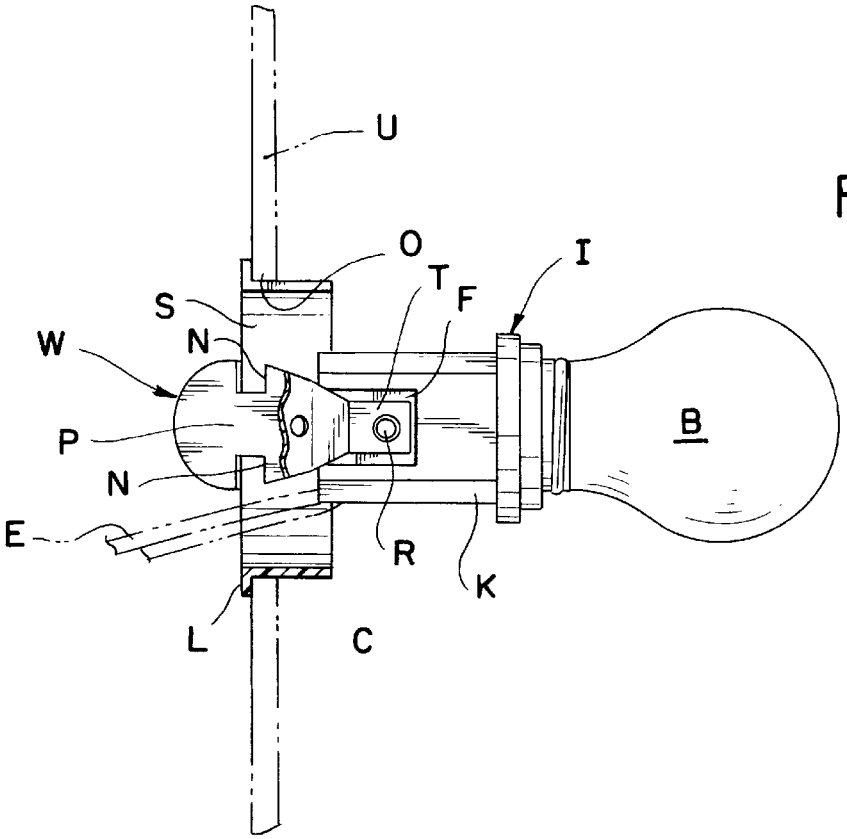
FIG. 2 is a side view partially in elevation and partially in vertical cross section along section line 2—2 of FIG. 1, the components of the conventional illuminating device being seen in side elevation.

FIG. 1 is an enlarged perspective view of a fragment, indicated in broken lines, of the rear wall of FIG. 3 showing the central opening with the embodiment of FIG. 3 of the protective shield of the invention, generally designated S, in operative position as in FIG. 3 and with a conventional illuminating device I in place. FIG. 1 in conjunction with the related cross-section of FIG. 2 more clearly conveys the structural details of the shield as well as of the illuminating unit. As seen in FIGS. 1 and 2, this embodiment is in the form of an annular cylinder. sleeve or ring C of an axial length at least equal to, and preferably greater than, the thickness of the rear wall U of the collectible. Sleeve C is split or interrupted at one point around its periphery by the removal of a short annular segment to create a gap G therein. The circumferential extent of gap G can be varied for a purpose to be explained shortly, but is generally short compared to the circumference as a whole.

Sleeve S is made of tough, hard but resilient durable plastic or the like. A preferred tough plastic as a polypropylene copolymer, probably with minor amounts of polyethylene in non-randomized or block-copolymeric form, which contains a flame retardant additive and is manufactured by DSM Engineering Plastics and available from General Polymers Division of Ashland Chemical Co. under the "grade" name of "Fiberfil PP-61/VO/NH". This copolymer is suitable for injection molding and has the following physical properties:

| | |
|---|---|
| Density/Specific gravity: | 1.0400 sp. gr. @ 23/24C |
| Flexural Modulus: | 23100 psi |
| Flexural strength @ yield: | 4230 psi |
| Tensile strength: @ yield: | 3220 psi |
| Notched Izod impact: | 2.01 ft.lb @ 73.2 F. @ 0.1250 in. |
| Thermal deflection temp. @ 264 psi: | 145 F. |
| Thermal deflection temp. @ 66 psi: | 216 F. |
| UL flammability: | V-O @ 0.627 in |

A tough nylon of comparable properties could be readily be substituted and while a plastic is preferred mainly for reasons of cost and simple shaping by molding, it is conceivable that spring steel or other resilient sheet metal could also be utilized.

In FIGS. 1 and 2, the adjacent ends at the split of the sleeve are in close almost abutting proximity, which represents a circumferentially compressed state necessary to conform the sleeve to the diameter of a circular opening of somewhat smaller diameter than the relaxed state of the sleeve. The normal relaxed state of the ring is illustrated in an alternative embodiment depicted in FIG. 5, about which more will be stated later. While there is no accepted fixed rule, in general the diameter of the circular rear openings in typical collectibles varies from about 2.5 to 3.0 cm and the separation of the split ends of the inventive protective sleeves is selected to accommodate easily to this size range. That is to say, the split sleeve in its relaxed open condition has a diameter of just over 3.0 cm, say about 32 mm, and in its fully compressed condition a diameter not greater than about 25 mm.

The relative diameter of the wall opening as shown in the drawings, where it is appears in somewhat enlarged or exaggerated size from its actual measurements, is at the lower end of this range so that when the sleeve is in position within the wall opening, its split ends are in virtual abutment. For larger openings, the split ends would be separated a greater distance but there should be at least a slight compression together of the ends when inserted into the circular opening to insure a sufficient frictional engagement of the ring periphery with the inner margin of the opening to hold the sleeve in place in the opening. That is to say, the relaxed diameter of the sleeve should preferably always be at least slightly larger than the wall opening diameter.

The split or gap in the sleeve can easily be formed by molding continuous sleeves to a diameter corresponding to the selected relaxed diameter and removing, e. g. by cutting or the like, a segment of the sleeve periphery of the length needed to achieve the smaller diameter when the split ends are compressed. The geometrical relationship of "circumference equals the factor Pi×the diameter", where Pi is 3.14157, can be used to calculate the appropriate segment length. For example, a difference in diameter of 5 mm converts to 15.71 mm. Alternatively, the sleeve could be molded directly with the gap in place.

It will be appreciated that if the wall opening diameter for a given production run or set of miniature collectibles were fixed in advance, it would be possible to configure the protective ring of the invention as a continuous or uninterrupted cylinder of a diameter selected to fit tightly snugly within such opening. This variation is deemed to be within the broad scope of the invention.

The length or axial dimension of the sleeve while not critical should be at least as great as the thickness of the associated wall of the collectible and preferably somewhat greater than that thickness. The wall thickness in FIG. 2 is slightly exaggerated.

From FIGS. 1 and 2, one can perceive that the sleeve is formed at one end (which is the outer end) with an integral annular or circumferential flange or lip L projecting outwardly perpendicularly of the cylinder axis a sufficient distance as to seat securely against the margins of the wall opening. The presence of this lip limits the extent to which the sleeve can penetrate into the wall opening. For a sleeve of an axial dimension (length) of about 1 cm (10 mm), a radial lip thickness of about 2 mm is entirely adequate but could be increased if preferred and could perhaps be decreased slightly to say 1 mm.

It will be self-evident that other forms of stop means for limiting sleeve penetration into the opening could be substituted for the lip such as external bump-like protuberances or the like at spaced points around one end of the sleeve. Alternatively, the lip need not extend completely around the sleeve end periphery but could be interrupted so long as at least about two segments were present to contact the margins of the wall opening. In the same vein, the sleeve could be formed in addition to the lip or equivalent with several peripherally spaced small externally projecting protuberances, not shown, located axially inwardly, i. e. towards the opposite end of the sleeve, from lip L approximately the thickness of the collectible rear wall. Such deformations would aid in preventing accidental withdrawal of a sleeve from the rear wall opening by engagement with inner margins of the opening upon attempted outward displacement of the sleeve. These protuberances could be rounded for easy passage over the opening edge and would be of a size such as slide past that edge when the sleeve was compressed for insertion within the opening.

The relationship of the illuminating unit, which is of conventional design, to the protective sleeve S as well as to the wall opening O also appears in FIGS. 1 and 2. This device includes a socket K of hard plastic or other non-conductive material having at one end an internally threaded, i. e. female threaded, recess not seen sized to accept the threaded base of a small base electrical light bulb B, say of 5 to 20 watts. Within the recess and also not seen in the drawings are the usual resilient metallic contacts for engagement with the conductive elements of the light bulb, these contacts being soldered or otherwise affixed to the ends of a two-wire electrical cord E shown in broken lines in the figures. The end of the cord would carry an electrical plug or the like, also not shown, for insertion into an electrical wall outlet, extension cord or other electrical source.

The end of the socket of the device opposite to the bulb recess is extended for provision thereon of two (or more) opposed flattened surfaces F for the attachment or anchorage there as by means of a common or separate rivets, screws or the like R of one end of two generally spatulate-shaped flat fingers W, one for each flattened surface which are formed of stiffly resilient spring steel. The attached ends T of the fingers each lies flat against flattened surfaces F (see FIG. 2) while the body and main portion B of each finger is bent outwardly of the flat end to extend like "wings" angularly outwardly, e. g. at an angle of roughly 25–30°, to the axis of the bulb socket K. While two spring fingers W are shown, their number could be increased to three or even four arranged at uniformly spaced points around the socket, the latter being provided with the appropriate number of flats for attachment of the finger ends T thereto.

The flat spring fingers serve as a convenient "handle" for insertion and removal of the illuminating device into and from the rear wall opening of the collectible, being pinched between the thumb and forefinger of the person preparing the collectible for display and compressed together enough to enter the wall opening and released when the unit was in position. Prior to the present invention, the spring fingers after introduction of the light bulb and socket through the wall opening into the hollow interior of the collectible and release, pressed directly against the exposed inner edge of the wall opening. Because the illuminating unit for ideal illuminating effect needs to be supported reasonably steadily horizontally in cantilevered fashion from the collectible rear wall, the spring tension of the spring fingers is relatively strong and the fingers in the past bore with considerable pressure against the exposed inner edge of the wall opening.

In addition, at a point from its free end equal to about one-third of the length of the unsupported body portion P, each spring finger is provided on opposite sides with detent means in the form, for example, of U-shaped notches or indentations N for positive "shoulder-to-shoulder" interengagement with edge margins of the collectible wall opening to secure the unit in place. The width of the notches is preferably slightly larger than the thickness of the wall so that the opening margins can catch in the notches. This catching action of the notches on the opening edge resulted in a scraping effect on that edge. Thus, unless extreme care were exercised in introducing the illuminating unit into the opening, there existed a distinct possibility, if not a virtual inevitability, for the edge of the wall opening to become chipped and cracked over time, especially after repeated insertion and removal of the unit.

In accordance with the invention, the protective shield is interposed between the edge and margins of the wall opening of the collectible and the spring fingers of the illuminating unit; it consequently receives the entire pressure contact of the spring fingers, thereby largely relieving the risk of damage to the opening from the spring finger force. The intersection of the lip and cylindrical surfaces of the sleeve defines a distinct corner on which the notches N of the fingers can effectively catch and hold and hence fix the axial position of the illuminating device within the collectible interior without actual direct contact with the opening edge by the spring fingers.

Figure 5:
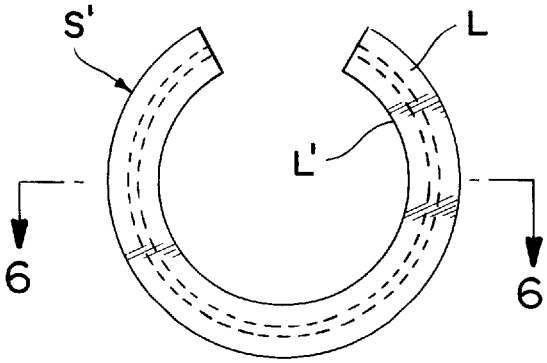
FIG. 5 is a front view of an alternative embodiment of the protective shield of the invention alone and in fully relaxed state, the alternative embodiment having an interior annular shoulder for more secure anchoring of the illuminating device.
Figure 6:
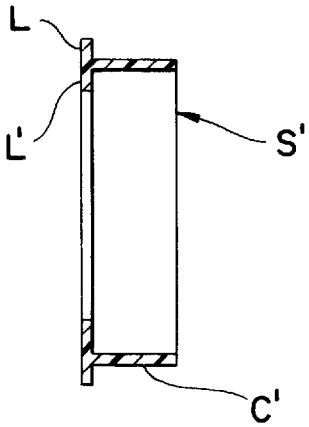
FIG. 6 is a vertical section taken along line 6—6 of FIG. 5.

An alternative embodiment S' of the present shield is shown in FIGS. 5 and 6. This version is similar to the first except that in addition to the exterior lip L, an annular flange or lip L' projects from the interior of the same end of the cylindrical ring surface again at about a perpendicular angle. The radial extent of the inner lip L' can be about the same as that of the outer lip L, namely about 2 mm, and its axial thickness of the inner lip L is relatively thin, say about 1 mm, although either or both of these dimensions can certainly be varied, so long as they are sufficient to allow the inner lip to project within the indentations N on the sides of the spring fingers. Since the inner lip L' can project deeply into the notches N, it creates a two-way detention action between the lip and spring fingers, making unintentional axial movement of the illuminating unit almost impossible.

The functions of the outer and inner lips are different and their radial thicknesses can be different but, in practice, it is convenient for the two lips to have the same thickness, e. g. about 3 mm. It will be immediately evident that the presence of the inner lip reduces the effective open internal diameter of the sleeve and hence reduces the tolerance of the sleeve for easy passage of the electric bulb for relatively small diameter rear wall openings. For instance, a bulb having the relative proportions seen in FIG. 2 would not be able to penetrate the sleeve of FIGS. 5 and 6 if the latter were fixed at the diameter seen in those figures. Of course, this problem could be easily circumvented by selecting a bulb of lesser diameter.

Although the injection molding procedure followed to obtain the protective sleeves of the invention would be obvious to one skilled in that field and, hence, is not a part of the invention, the following conditions are applicable for the polypropylene copolymer specified above and may be of interest:

Injection Molding Conditions

Back pressure: 0–50 psi

Drying temperature: 150° F.

Drying time: 2.00 hr

Front temperature: 401–411° F.

Injection rate: moderate

Middle temperature: 391–421° F.

Mold temperature: 80–120° F.

Nozzle Temperature: 401° F.

Processing (melt) temperature: 391–421° F.

Rear temperature: 361–386° F.

Suggested Max moisture: 0.20%

It will be understood that the invention is not intended to be limited to the particular embodiments that has been depicted and described in detail but extends to variations that would be apparent to one skilled in the art and fall within the scope of the appended claims.

That which is claimed is:

1. A protective shield for a hollow illuminated collectible structure which is constructed of frangible material and has a rear wall provided with an opening for reception of an illuminating unit comprising an electrical light bulb, an electrical socket for said bulb for supplying electrical current thereto to energize the same, said bulb and socket being of a size such as to pass through said opening, and at least a pair of resilient spring fingers affixed at one of their respective ends to opposite sides of said socket and extending at their opposite ends angularly outwardly therefrom in generally V fashion away from said bulb for mounting said unit within the structure interior, free end portions of said fingers having a transverse separation greater than one dimension of said wall opening, said shield comprising an annular sleeve of generally tough resilient material of an axial length at least generally equal to the rear wall thickness of said collectible structure, said sleeve having at one end thereof an internal corner extending around its inner perimeter and stop means adjacent said one end for limiting the penetration of said sleeve within said opening, said sleeve passing through said rear wall opening in frictional engagement with an inner edge of said opening, said sleeve being interposed between the spring fingers of said unit and the inner edge of said wall opening with the spring fingers pressed together to fit within said sleeve as limited by said one opening dimension, said spring fingers carrying on said free end portions indentations for gripping said interior corner of said sleeve to secure said unit in position within the structure interior.

2. A protective shield as in claim 1 wherein said stop means is in the form of an annular lip at said one end of said sleeve which extends over at least opposed arcuate segments of the sleeve circumference and projects generally perpendicularly of the sleeve axis to define with the sleeve an interior corner along said segments, said lip being in contact with exterior margins of said opening to limit penetration into the opening by said sleeve.

3. A protective shield as in claim 1 wherein said rear wall opening in generally circular in shape and said sleeve is generally cylindrical and frictionally fits within said generally circular opening.

4. A protective shield as in claim 3 wherein a short arc of the sleeve circumference is removed to create a peripheral slot to enable free ends on either sides of said slot to be resiliently pressed toward one another to thereby alter the diameter of the sleeve to accommodate to a smaller diameter wall opening.

5. A protective shield as in claim 4 wherein said rear wall opening in said structure have a diameter ranging between a minimum and a maximum and the diameter of said slotted sleeve when in a relaxed state is slightly greater than said maximum opening diameter whereby said sleeve ends must be slightly pressed together to fit within said maximum diameter opening and thus frictionally contact said opening edge and the diameter of said sleeve when the slotted ends are pressed substantially into abutting contact is such as to fit within a wall opening of minimum diameter.

* * * * *